US012747660B1

(12) United States Patent
Abughaban et al.

(10) Patent No.: US 12,747,660 B1
(45) Date of Patent: Sep. 29, 2026

(54) MONITORING DRILLING RIG OPERATIONS

(71) Applicant: Saudi Arabian Oil Company, Dhahran (SA)

(72) Inventors: Mahmoud Abughaban, Saihat (SA); Abrar Alshaikh, Dhahran (SA); Hamzah Nader Abushullaih, Dhahran (SA); Georgy Peshkov, Moscow (RU)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/089,730

(22) Filed: Mar. 25, 2025

(51) Int. Cl.

| | |
|---|---|
| ***E21B 44/00*** | (2006.01) |
| ***E21B 21/06*** | (2006.01) |
| ***E21B 41/00*** | (2006.01) |
| ***E21B 47/00*** | (2012.01) |

(52) U.S. Cl.
CPC ..... *E21B 44/00* (2013.01); *E21B 21/062* (2013.01); *E21B 41/00* (2013.01); *E21B 47/00* (2013.01)

(58) Field of Classification Search
CPC ..... E21B 44/00; E21B 41/0099
See application file for complete search history.

(56) References Cited

U.S. PATENT DOCUMENTS

| | | | | |
|---|---|---|---|---|
| 10,430,897 | B2 | 10/2019 | Khare et al. | |
| 10,626,713 | B2 | 4/2020 | Boone | |
| 10,754,334 | B2 | 8/2020 | Cella et al. | |
| 10,891,573 | B2 | 1/2021 | Foubert et al. | |
| 11,521,324 | B2 * | 12/2022 | Schmidt | G06F 18/2413 |
| 11,698,473 | B2 | 7/2023 | Torlov et al. | |
| 11,962,957 | B1 * | 4/2024 | Converset | H04Q 9/00 |
| 12,000,261 | B2 * | 6/2024 | Liu | E21B 44/02 |
| 12,197,201 | B2 * | 1/2025 | Boguslawski | G05B 23/0254 |
| 12,215,573 | B2 * | 2/2025 | Snijder Van Wissenkerke | H02J 3/28 |
| 12,385,381 | B2 * | 8/2025 | Laing | G06F 16/35 |
| 2024/0418070 | A1 * | 12/2024 | Robinson | E21B 45/00 |
| 2025/0264016 | A1 * | 8/2025 | LaCroix | E21B 44/02 |

FOREIGN PATENT DOCUMENTS

WO WO 2022159124 A1 7/2022

* cited by examiner

*Primary Examiner* — Kenneth L Thompson
(74) *Attorney, Agent, or Firm* — Fish & Richardson P.C.

(57) ABSTRACT

Example methods and systems for monitoring drilling rig operations are disclosed. One example method includes obtaining, by an edge server at a drilling rig site during a drilling operation of a wellbore and as obtained data from sensors at the drilling rig site, data from sensors at the drilling rig site. The data includes at least drilling fluid data and drilling equipment data associated with the drilling operation. A drilling morning report is generated by the edge server and based on the obtained data from sensors at the drilling rig site and input from a user. The drilling morning report includes formation tops of the wellbore and gate access information of personnel and equipment at the drilling rig site. The drilling morning report is provided to perform the drilling operation at the drilling rig site.

20 Claims, 5 Drawing Sheets

MONITORING DRILLING RIG OPERATIONS

TECHNICAL FIELD

The present disclosure relates to computer-implemented methods and systems for monitoring drilling rig operations.

BACKGROUND

Drilling activities at hydrocarbon drilling rigs can be tracked using a variety of sensors obtaining data during drilling of a wellbore. Examples of the sensors can include depth-tracking sensors (e.g., for hookload and/or draw-works), flow-tracking sensors (e.g., for flow-in and flow-out), gas-detection sensors, pressure-tracking sensors, drill-monitoring sensors (e.g., for top drive revolutions per minute (RPM) or torque), and/or pit-monitoring sensors (e.g., for fluid levels in mud, water, or waste tanks). The sensors can provide information about the physical properties of the wellbore from the surface to the bottomhole. Data from the sensors can be sent through connections (e.g., wired connections) to a server for data collection. Using additional communication channels, for example, very small aperture terminal (VSAT), the data can then be sent to a remote site (such as, headquarters of the operator of the drilling rig site) for processing, analysis, and/or reporting.

SUMMARY

The present disclosure involves methods and systems for monitoring drilling rig operations. One example method includes obtaining, by an edge server at a drilling rig site during a drilling operation of a wellbore and as obtained data from sensors at the drilling rig site, data from sensors at the drilling rig site. The data includes at least drilling fluid data and drilling equipment data associated with the drilling operation. A drilling morning report is generated by the edge server and based on the obtained data from sensors at the drilling rig site and input from a user. The drilling morning report includes formation tops of the wellbore and gate access information of personnel and equipment at the drilling rig site. The drilling morning report is provided to perform the drilling operation at the drilling rig site.

The previously described implementation is implementable using a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium. These and other embodiments may each optionally include one or more of the following features.

While generally described as computer-implemented software embodied on tangible media that processes and transforms the respective data, some or all of the aspects may be computer-implemented methods or further included in respective systems or other devices for performing this described functionality. The details of these and other aspects and implementations of the present disclosure are set forth in the accompanying drawings and the description below. Other features, objects, and advantages of the disclosure will be apparent from the description and drawings, and from the claims.

BRIEF DESCRIPTION OF DRAWINGS

Like reference numbers and designations in the various drawings indicate like elements.

DETAILED DESCRIPTION

Figure 1:
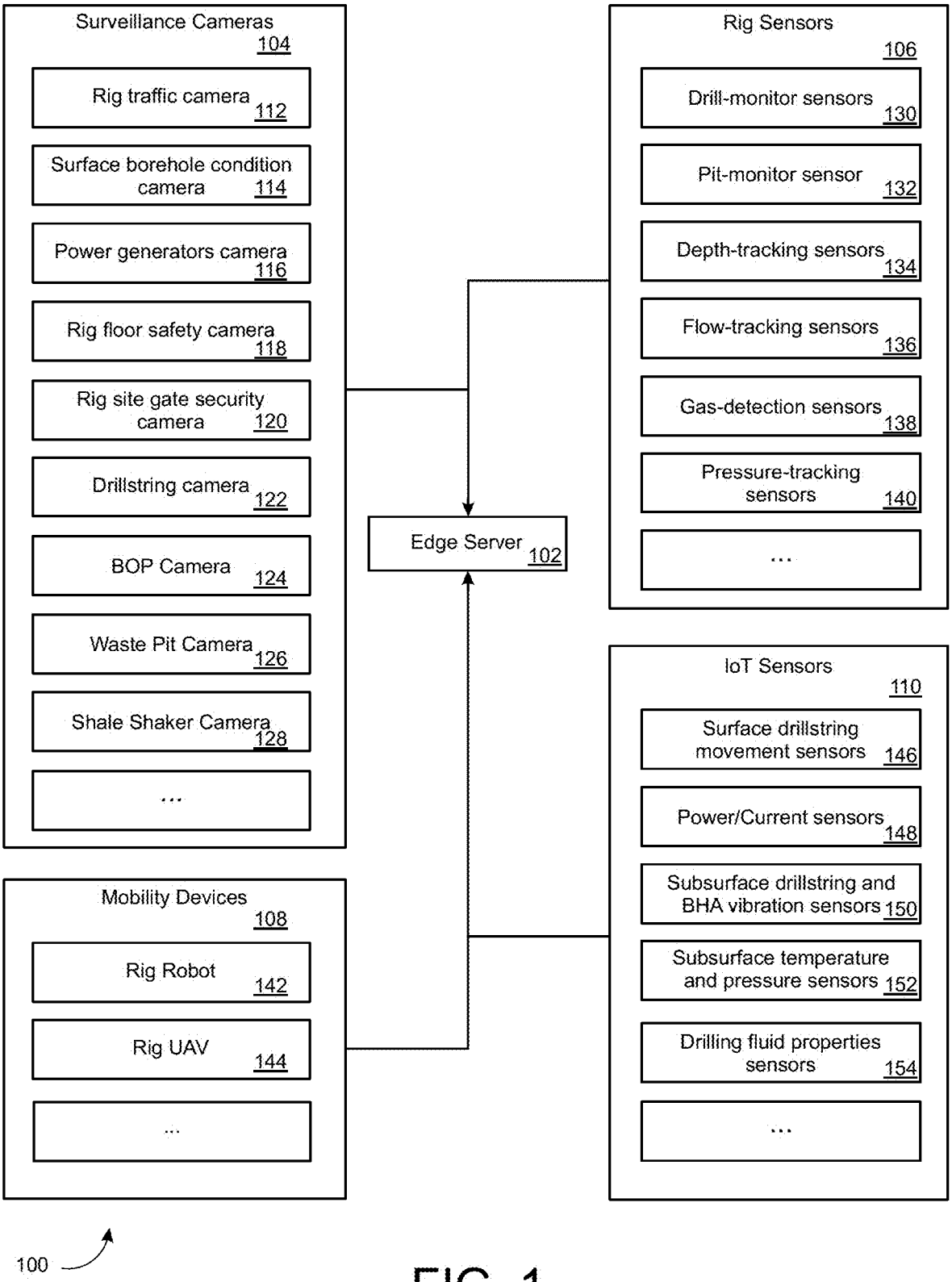
FIG. 1 illustrates an example data collection system for drilling rig operations, according to some implementations.

Instead of sending data collected at a drilling rig site to a remote site for analysis, data can be generated and analyzed in real-time at the drilling rig site (e.g., by an edge server that provides edge computing services at the drilling rig site) to make full use of the data with reduced loss in data resolution. In drilling for hydrocarbon, various technologies can be used to generate data about systems at a drilling rig site and areas surrounding the site. Examples of the systems can include drilling rig systems, control systems, hoisting systems, rotary systems, power systems, and/or hydraulics systems. Examples of the technologies used to generate the data about the systems can include camera-based monitoring systems, sensor-based systems, and/or mobility-based systems. The data can be generated in real-time and can be fully utilized using edge-computing.

In some cases, drilling foremen of a drilling rig site can fill out a 24-hour drilling rig report (i.e., a daily drilling report or morning reports) summarizing operations at the drilling rig site during the past 24 hours and a plan for the next 24-hour of operations. The 24-hour drilling rig report is a record of the rig and well history for the operator of the drilling rig site, and can be comprehensive of operations concerning well construction, completion, workover, resources consumptions, or abandonment, as well as rig movement and maintenance activities. The 24-hour report can include sections for information such as: (1) time-based record of operation summary, status, and progress; (2) lithology record of the formations drilled; (3) bottom hole assembly (BHA) and drilling bit specifications; (4) drilling fluid measurements every 12 hours; (5) directional survey; (6) water consumption; (6) diesel consumption; (7) drilling troubles or non-productive time details; (8) health, safety, and environment related concerns or events; and/or (9) rig visitors' log.

In some cases, the daily reports can require a significant amount of time to prepare due to time needed to aggregate data from different sources across the drilling rig site. Furthermore, manual completion of the daily reports by a drilling foreman can make the daily reports prone to inclusion of human errors (for example, spelling mistakes and/or inaccuracies in the data entered). Corrections to the daily reports may be performed later, for example, by engineers, and can take additional time to complete.

This disclosure describes systems and methods for automating generation of interactive reports, for example, live and dynamic operational reports, of drilling rig sites, and for applying the generated reports to drilling-related activities.

The reports can include technical aspects of and/or operational activities at the drilling rig sites, and can be used to monitor different aspects of drilling operations at the drilling rig sites. In some cases, the disclosed method can be used to generate 24-hour summary reports, for example, the daily drilling reports (i.e., drilling morning reports), based on data collected by different sensors at the drilling rig sites. In some cases, the disclosed method can generate the reports and/or provide additional information in different sections in the reports, based on input, for example, real-time input, from users and through an interactive interface.

In some implementations, the data can be collected from various sensors, for example, surveillance cameras, rig sensors, Internet of Things (IoT) sensors, or rig mobility devices. A drilling morning report can be generated based on downhole and surface drillstring vibration data, footage of the rig floor, and/or gate access data. Real-time adjustments to drilling fluid or operational parameters can be provided based on the generated reports. In some cases, the collected data can be analyzed and processed by an edge server to generate actionable insights or trigger predefined actions, for example, adjusting operational parameters of drilling equipment based on predefined thresholds.

In some implementations, a computer system, for example, an edge server, can track power-related measurement data in real time, for example, diesel consumption, power generation, and/or power distribution, and use the data to improve operational efficiency. The computer system can automatically adjust power usage by balancing generator loads, improving equipment operation, and/or triggering alerts if predefined thresholds are exceeded. Additionally, the computer system can adjust operational parameters such as pump rates or rotary speeds based on efficiency analysis.

In some implementations, the computer system can analyze drilling fluid properties in real-time to adjust fluid composition or detect circulation losses, use vibration data to identify formation tops, or generate real-time reports to improve operational parameters.

In some implementations, the computer system can collect data using sensors such as mud tank fluid level gauges, rheology and density meters, vibration sensors, and/or power/current sensors. The computer system can process the collected data to generate reports, such as a drilling morning report, that contains information about drilling fluid status, power consumption, and/or formation tops. Based on the reports, the computer system can adjust drilling fluid composition, improving power distribution, and/or triggering alerts for anomalies.

The disclosed approach provides many advantages over existing systems. As an example, a disclosed method can reduce errors in data entry (such as spelling mistakes, errors in manual calculations, etc.) of the reports. As another example, the disclosed method can save time for people responsible for writing, checking, and/or processing the reports for documentation. Furthermore, the disclosed method can provide real-time information such as charts and statistics upon request (e.g., from a user and/or automated computer process) and present the latest information about operations associated with the drilling rig sites. In some cases, real-time information about operations, equipment, and personnel associated with the drilling rig sites can facilitate more accurate compensation calculations for drilling operations and improve different operational aspects of the drilling rig sites. An additional example of the advantages is the ability to store all data in one place in an organized manner, which can make access to the results of the system's work very convenient, systematic, and interactive.

FIG. 1 illustrates an example data collection system 100 for drilling rig operations, according to some implementations. In some implementations, data collection system 100 can aggregate data collected from multiple sources (e.g., sensors) at a drilling rig site used for drilling a wellbore. The data can be related to systems at the drilling rig site and the areas surrounding the drilling rig site. The sources for collecting the data at the drilling rig site can include different types of sensors. For example, the sensors can include surveillance cameras 104, rig sensors 106, mobility devices 108, and/or internet of things (IoT) sensors 110. Surveillance cameras 104 can include cameras monitoring different systems at the drilling rig site and/or areas surrounding the drilling rig site. For example, in some implementations, surveillance cameras 104 can include a rig traffic camera 112, surface borehole condition camera 114, power generators camera 116, rig floor safety camera 118, rig site gate security camera 120, drillstring camera 122, blowout preventor (BOP) camera 124, waste pit camera 126, and/or shale shaker camera 128. In some implementations, rig sensors 106 can include sensors monitoring different aspects of the process of drilling the wellbore, for example, drill-monitor sensors 130, pit-monitor sensor 132, depth-tracking sensors 134, flow-tracking sensors 136, gas-detection sensors 138, and/or pressure-tracking sensors 140. In some implementations, mobility devices 108 can include rig robot 142 and/or rig unmanned aerial vehicle (UAV) 144. In some implementations, IoT sensors 110 can include surface drillstring movement sensors 146, power/current sensors 148, subsurface drillstring and bottomhole assembly (BHA) vibration sensors 150, subsurface temperature and pressure sensors 152, and/or drilling fluid properties sensors 154.

Figure 2:
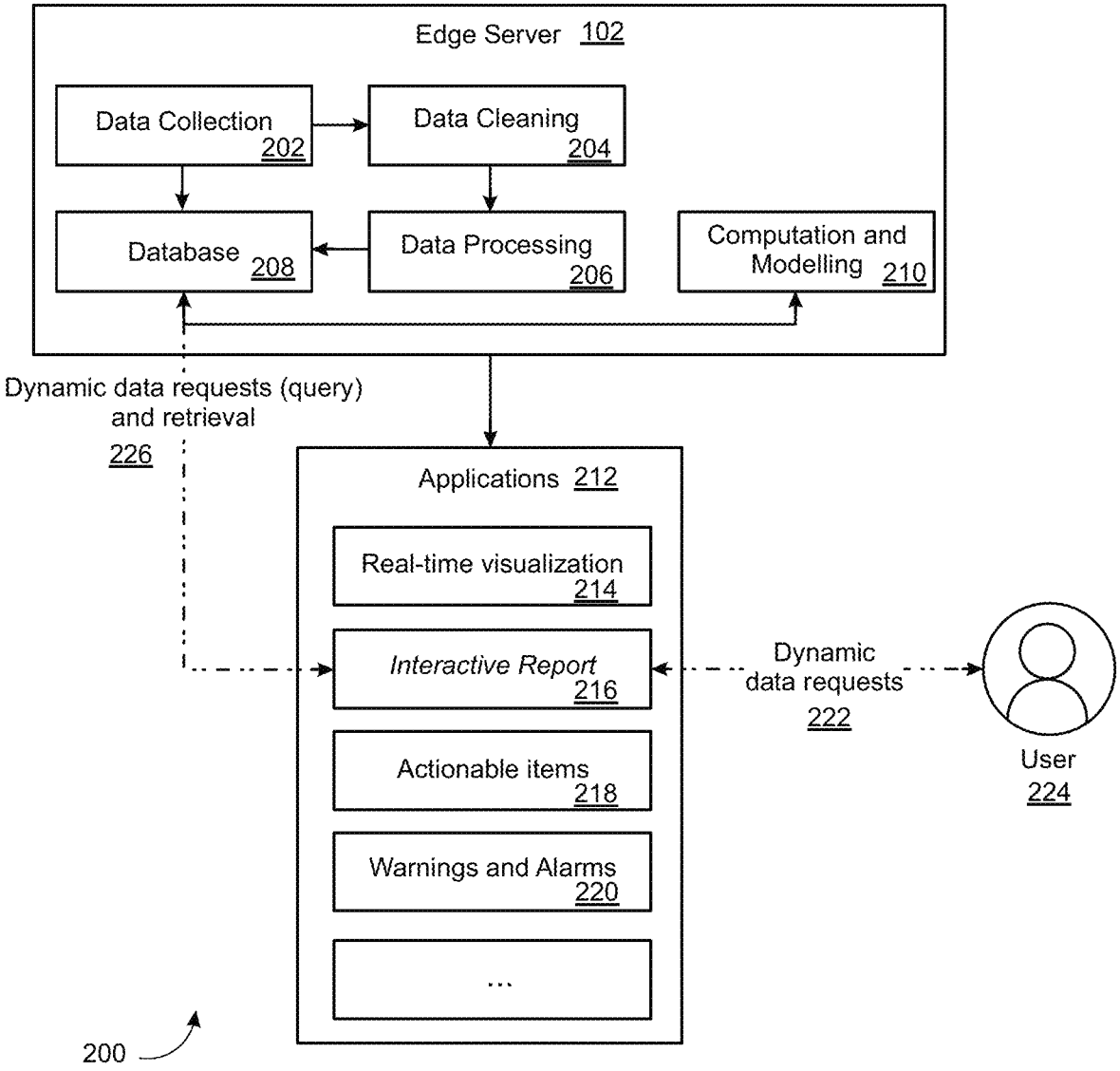
FIG. 2 illustrates an example system for auto-generating reports of drilling rig sites and applying the reports, according to some implementations.

In some implementations, data collected from the aforementioned sensors can be aggregated at edge server 102, which provides edge computing services at the drilling site (i.e., the edge), as further described in FIG. 2. Examples of how the data from the aforementioned sensors are used to auto-generate an interactive report of the drilling rig site will be described later.

FIG. 2 illustrates an example system 200 for auto-generating reports of drilling rig sites and applying the reports, according to some implementations. At 202, edge server 102 can collect various types of data related to a drilling rig site from sensors 104, 106, 108, and/or 110 described in FIG. 1. At 204, edge server 102 can clean the data collected at 202 to remove irregularities in the data and/or handle missing measurements in the data. For example, edge server 102 can remove data that are irrelevant, duplicative, mislabeled, incomplete, and/or of an incorrect format. At 206, the cleaned data can be further processed. For example, edge server 102 can check the cleaned data for accuracy, completeness, consistency, alignment with time (if applicable), and/or interpretability. In some cases, edge server 102 can integrate the cleaned data, reduce the dimensions of the cleaned data, transform the cleaned data, and/or extract features, attributes, or variables from the cleaned data. At 208, the processed data can be stored in a database. At 210, the stored data can be used for computation and modeling related to different aspects of the drilling process of the wellbore, as further described later. The computation results and models generated at 210 can also be stored in the database.

In some implementations, machine learning models used in this invention can be custom-designed to meet the requirements of real-time data collection, processing, and/or decision-making at the drilling rig site. The machine learning models may include modifications to existing architectures, such as layer adjustments, tailored activation functions, or specialized application programming interfaces (APIs) to enhance performance, accuracy, and robustness in the context of drilling operations. For example, convolutional neural networks (CNNs) or transformer-based architectures can be adapted for computer vision tasks, such as analyzing cuttings or rig-floor footage, while recurrent neural networks (RNNs) or time-series forecasting models can be adjusted for real-time data streams from sensors. Changes to the logic of the aforementioned models, for example, the integration of domain-specific knowledge and custom feature engineering pipelines, can ensure better interpretability and performance in applications such as drilling for hydrocarbon.

In some implementations, user 224 can refer to either a human operator of system 200 or an automated computer process that requests and utilizes results generated from applications at 212, without human intervention. For example, the automated computer process can query real-time data, trigger predictive analysis, or initiate automated actions, such as generating warnings or controlling equipment.

In some cases, machine learning models can involve using one or more data analysis methods to generate information from the data collected, for example, using computer vision-based methods to identify specific items from visual data sources (e.g., photos and videos) or using neural networks to identify patterns in the data collected or to categorize specific data points. In some cases, machine learning models that produce higher quality output in terms of accuracy and precision can be chosen for collecting and processing data in real-time.

In some implementations, training and re-training of the machine learning models can be performed as more data are generated over time. In some cases, training and re-training of the machine learning models are integral to the disclosed methods. System 200 can support incremental learning and continuous improvement as more data is gathered over time. Training of the machine learning models can occur periodically or on-demand, using new data collected during drilling operations, which can include updated sensor readings, drilling reports, and/or operational logs. Re-training of the machine learning models can ensure that the models can adapt to changing conditions, such as new geological formations or updated equipment configurations. Data augmentation techniques, transfer learning, and/or ensemble methods may be employed to further enhance model accuracy and resilience against anomalies. The re-training process can integrate with the edge-computing infrastructure to maintain operational efficiency while minimizing latency.

At 212, the stored data, computation results, and/or generated models can be used in different types of applications. For example, at 214, the stored data, computation results, and/or generated models can be provided for visualization in real-time. At 216, interactive reports about the drilling rig site can be generated, for example, upon dynamic data requests at 222 from a user 224, based on the stored data, computation results, and/or generated models retrieved at 226 in response to the dynamic data requests at 222. The interactive reports generated at 216 can include targeted and/or in-depth information requested by user 224 for certain aspects of the drilling rig site. At 218, additional actionable items can be performed automatically or manually based on information derived from the stored data, computation results, or generated models. Examples of actionable items include adjusting drilling fluid composition to mitigate circulation losses, modifying operational parameters (e.g., pump rates, rotary speeds) in response to real-time data, or issuing automated commands for shutting down equipment in hazardous conditions such as detecting a kick or gas influx. At 220, warnings and alarms can be generated based on the stored data, computation results, and/or generated models. Examples of how system 200 aggregates the collected data from various sources to auto-generate reports of the drilling rig stie and applies the reports will be described next.

In some implementations, system 200 can perform real-time tracking and reporting of the drilling fluids at the drilling rig site to determine the mix of different types of drilling fluids for the drilling operations at the drilling rig site in real-time, instead of relying on the less-representative measurement data that are reported periodically, for example, once every 12 hours, in existing systems. The drilling fluid data can be reported in a drilling rig report (e.g., a drilling morning report), for example, in a section for drilling fluid types. In some cases, system 200 can automatically adjust the drilling fluid mixture and composition in response to real-time data insights. For instance, if circulation losses are detected based on inflow and outflow sensor data, system 200 can inject additives into the drilling fluid to mitigate these losses. In some cases, adjustments to density, viscosity, or solid content can be performed autonomously to improve fluid performance for specific formations being drilled. In some cases, the aforementioned automatic adjustments can be guided by predefined operational thresholds and/or machine learning models that analyze historical and real-time data to recommend changes.

In some implementations, real-time drilling fluid measurements of a rig can be used for the generation of mud data (or drilling fluid data) as well as other parameters such as formation tops, summary of operations, water consumption, and/or waste generation. In some cases, a network of water and mud measurement units (e.g. sensors, cameras, or flow meters) can be connected at various points of a mud flow pipeline (e.g. at the inlet of the pump, inside the well, at the outlet of the shale shakers, at the outlet of the desanders or desilters, at the mixer, or at the outlet of the mud tank) to collect continuous measurements of the rig's fluid (e.g. flow rate, density, solid content, rheology, temperature, drilling cuttings characteristics, or cuttings volume) at the various points of the fluid flow. In some cases, system 200 can automatically use the real-time drilling fluid measurements of the rig to adjust the composition of additives during mud mixing for re-use. For instance, when sensors detect a reduction in density or a significant change in rheology at the outflow line, system 200 can automatically inject specific additives (e.g., barite or polymers) to restore predefined fluid properties. The density and rheology parameters can be recorded in the mud data (or the drilling fluid data) and the mud treatment sections of a drilling rig report for reporting. The aforementioned automated adjustments can be guided by machine learning models and/or predefined operational parameters that take into account historical data and real-time conditions. In some cases, the difference between the measurements of the inflow and outflow meters can provide information about the loss of circulation and can be recorded in the summary of operations section of a drilling rig report for reporting.

In some implementations, system 200 can track power related measurement data, for example, diesel consumption, power generation, and power distribution, in real-time, with respect to the live drilling activities, to improve diesel usage and/or reduce greenhouse gas (GHG) generation during a drilling cycle. The power related measurement data can be reported in a drilling rig report (e.g., a drilling morning report), for example, in a section for power consumption. In some cases, system 200 can automatically adjust power distribution or trigger alerts based on the power-related measurement data. For example, if diesel consumption exceeds predefined levels or if power generation deviates from expected parameters, system 200 can automatically balance the load between generators or adjust the operational parameters to improve fuel efficiency and reduce emissions.

In some implementations, combining the tracked diesel consumption data with data generated by other monitoring systems at the drilling rig site, for example, electrical current meters at the power distributer unit (to generate data for the Amperes drawn for each piece of rig equipment) and a monitoring system for power generator operations (to generate data for hours of operation per generator), can provide information about diesel consumption, generators efficiency, and/or GHG emissions. In some cases, system 200 can automatically adjust generator load distribution or trigger alerts based on the analysis of the aforementioned parameters. For instance, if diesel consumption exceeds predefined levels or if generator efficiency drops below a predefined threshold, system 200 can automatically balance load across generators, adjust operational parameters, or suggest maintenance actions to improve efficiency and reduce GHG emissions.

In some implementations, diesel consumption data combined with data in the summary of operations section of a drilling rig report (described later), as well as other parameters, for example, pump rate and revolutions per minute (RPM), which are collected by rig sensors on the drillstring and the mud pumps, can provide information about the power usage efficiency and output recommendations to improve the efficiency of power consumption at the drilling rig site. In some cases, system 200 can automatically adjust drilling operations based on the analysis of power usage efficiency. For example, if power consumption exceeds predefined levels or if efficiency drops, system 200 can automatically adjust the pump rate, RPM, or other parameters to improve power usage. Additionally, system 200 can trigger alerts or suggest operational adjustments to reduce energy waste and improve fuel efficiency, ensuring that the rig operates within the more efficient power consumption parameters.

In some implementations, system 200 can perform real-time analysis of the downhole and surface drillstring vibration data from the subsurface drillstring and BHA vibration sensors 150 and the surface drillstring movement sensors 146 respectively, cross-referenced with a drilling plan as well as the analytics of the cuttings generated at the flow out at the shale shaker, to auto-generate depths of formation tops once the formation tops are hit by the drillstring during a drilling operation. In some cases, system 200 can provide a real-time representation of the number of cuttings during a drilling operation, based on data from a cuttings camera, to monitor the shale shaker, the sizes or shapes of the cuttings, and/or irregularities of the cuttings. System 200 can use the auto-generated depths of formation tops to identify formation change and/or detect depth where formation top was penetrated. The depths of formation tops data can be reported in a drilling rig report (e.g., a drilling morning report), for example, in a section for formation tops.

In some implementations, drilling cuttings can come in different shapes and colors, depending on the formation type, drilling fluid used, and/or the drilling bit used. Each formation of a wellbore can have its vibration signatures downhole and at surface, based on the formation type, rock geomechanics (e.g., nature or induced fractures in the formations, or formation deposition angles), drillstring assembly configuration, and/or wellbore geometry (e.g., diameter, inclination, and/or azimuth of the wellbore). Edge server 102 can analyze (1) the physical form of the drilling cuttings (e.g., using computer vision or machine learning algorithms on camera produced imagery), (2) the wellbore geometry, and/or (3) the vibration data (e.g., downhole and at surface, using measurements from gyroscope and accelerometer sensors), to identify the signatures of entering a new formation (i.e., drilling through a new formation top). System 200 can report the identified signatures as a formation top identified, in cross-reference with the anticipated geological formations (i.e., the name of the formation), and depth of penetration, for example, in feet, with reference to rig floor or sea level obtained from the hoisting system's existing sensors such as the draw-works/crown encoder. In some cases, system 200 can automatically adjust drilling parameters based on the identified formation top. For example, once the formation top is detected, the system can adjust the weight on bit (WOB), rotary speed, or mud flow rate to improve drilling performance and ensure efficient drilling through the new formation. Additionally, the system can trigger alerts for the drilling crew to prepare for the transition, such as adjusting the drilling fluid properties or preparing for potential changes in formation pressure.

In some implementations, system 200 can use one or more rig-floor safety cameras 118 to collect and analyze, for example, using machine learning algorithms, the footage of the rig floor, to identify the major operation that is being conducted by the drilling rig. In some cases, system 200 can cross-analyze footage of the rig floor with the drilling parameters generated by other drilling rig sensors 106, for example, depth-tracking sensors 134, drill-monitor sensors 130, and/or flow-tracking sensors 136, to determine the wellbore depth, the depth of event, and/or the drilling activity that is conducted with respect to each time window specified by user 224, in real-time. The identified major operations and/or drilling activity related data can be reported in a drilling rig report (e.g., a drilling morning report), for example, in a section for summary of operations. In some cases, system 200 can automatically adjust drilling parameters based on the identified operation. For example, if system 200 identifies a change in operation, such as transitioning from drilling to tripping, it can adjust relevant parameters like the mud flow rate, WOB, or the rate of penetration (ROP). Additionally, system 200 can alert the drilling crew to operational anomalies or trigger pre-configured responses to improve the process, thus improving safety and operational efficiency.

In some implementations, the summary of operations section can be used to describe the current operation that is ongoing at the drilling rig site, any irregularities at the drilling rig site, and/or remedial action taken to address the irregularities.

In some implementations, rig floor footage, in cross reference with other rig sensors at surface (e.g., hook load sensor, draw-works/crown encoder, top driver or rotary system sensor, and/or sensors for pump rates and pressures, flow rates out, tank levels, and/or pit levels), and mud system sensors, can generate different signatures for different operations conducted at the drilling rig site. For example, during an active drilling operation of penetrating a new rock formation, the signatures associated with operations conducted around a rig can include: (1) drilling crew at the rig floor connecting drill pipes; (2) draw-works/crown encoder showing increased hole and bit depths; (3) the rotary system of the rig showing non-zero RPM and torque; (4) the flow out system of the rig showing new cuttings generated at the shale shakers; and/or (5) pumps showing non-zero pump rates. Similarly, other operations can also have unique combinations of signatures (from different sensors) that can be used to identify the operations that are performed at the drilling rig site at a specific time. In some cases, based on the identified operations, system 200 can automatically adjust relevant drilling parameters, such as the mud flow rate, RPM, pump pressure, or WOB. Additionally, system 200 can initiate automatic alerts to the drilling crew if it detects deviations from expected operation signatures, enabling quicker responses to operational anomalies and improving overall efficiency and safety.

In some implementations, drilling irregularities can be identified using the corresponding signatures. For example, in the case of loss of circulation, the remedial action can involve pumping of lost circulation material (LCM) or cement. Both the loss of circulation and its remedial action can be identified by monitoring measurements from the aforementioned mud system sensors. In some cases, system 200 can automatically detect the loss of circulation based on sensor data, trigger an alert, and initiate corrective actions such as the automatic injection of LCM or cement through the mud system, based on predefined thresholds and operational conditions. Alternatively, the system can assist an operator by providing real-time recommendations for corrective actions, allowing the operator to take manual control if necessary.

In some implementations, system 200 can utilize an automated gate access device (e.g., a tagging device) at a gate of the drilling rig site to tag the entry and exit times of all personnel at the drilling rig site, as well as trucks and their associated service company's information and service details, for example, wireline truck from a specific company with a specific number of personnel. The entry and exit data can be reported in a drilling rig report (e.g., a drilling morning report), for example, in a section for visitors and vehicles on location/personnel and services information.

In some implementations, system 200 can utilize connection to hydrogen sulfide (H2S) sensors and/or other gas detection sensors at the drilling rig, as well as rig floor safety cameras 118 and/or rig site gate security cameras 120 to generate a representation of safety at the drilling rig site. In some cases, system 200 can automatically monitor the aforementioned safety indicators in real-time and trigger automated actions based on predefined safety protocols. For example, if hazardous gas concentrations exceed safe thresholds, the system can automatically alert personnel, initiate evacuation protocols, or activate safety measures such as ventilation systems or gas scrubbers. Additionally, system 200 can provide real-time safety status updates to operators, enhancing situational awareness. The safety related data can be reported in a drilling rig report (e.g., a drilling morning report), for example, in a section for safety.

In some implementations, system 200 can utilize an automated tagging device at a gate at the drilling rig site to collect data of equipment accessing the gate, to track all pieces of equipment at the drilling rig site for the number of times of entries and exits. In some cases, based on the entry and exit data, system 200 can automatically update the equipment inventory, flagging equipment that has entered or exited the site. System 200 can also trigger alerts if certain equipment is overdue for maintenance, if unauthorized equipment is detected, or if there are any anomalies in the expected equipment flow. Additionally, the system can generate reports on equipment usage patterns, improving asset management and scheduling. The entry and exit data can be reported in a drilling rig report (e.g., a drilling morning report), for example, in a section for wellsite equipment on location.

In some implementations, system 200 can utilize sensors that monitor the drilling fluid going into and out of the wellbore in real time, for example, mud tank fluid level gauges, surface rheology and density meters, downhole density and rheology sensors, and/or other systems that measure and report mud data in real time, to generate a real-time record of the drilling fluid status throughout a drilling cycle of the wellbore. In some cases, based on the real-time record of the drilling fluid status, system 200 can automatically adjust the drilling fluid composition, such as adding more fluid or adjusting the density or rheology, if it detects deviations from predefined conditions. System 200 can also flag potential issues like low fluid levels or irregularities in fluid properties, triggering alerts for the operator to take corrective actions. The drilling fluid status related data can be reported in a drilling rig report (e.g., a drilling morning report), for example, in a section for mud data.

In some implementations, system 200 can connect the sensors on power generators, for example, power/current sensors 148, real-time current meters and/or power generators cameras 116, to a centralized edge-computing unit (e.g., edge server 102), to get readings of diesel consumed, power generated, and/or power utilized by different pieces of rig equipment. In some cases, based on the readings of diesel consumed, power generated, and power utilized, system 200 can automatically improve power usage by adjusting the operation of certain equipment to ensure efficient energy consumption. For example, system 200 could reduce the power usage of non-essential equipment during high-demand periods or activate standby power generation when needed. Additionally, system 200 could automatically trigger alerts if diesel consumption or power usage exceeds predefined thresholds, signaling potential inefficiencies or operational issues. The diesel-related data can be reported in a drilling rig report (e.g., a drilling morning report), for example, in a section for diesel consumption.

In some implementations, system 200 can utilize real-time data from intelligent water meters to record continuous data of water quantities consumed as a time series and to correlate the real-time data with the current drilling activities at the drilling rig site. In some cases, based on the water-related data, the system can automatically improve water usage by adjusting the operation of water-consuming equipment or processes. For example, it could reduce water usage during non-critical operations or activate water-saving measures when consumption exceeds predefined thresholds. System 200 can also trigger alerts if water usage becomes abnormally high, signaling potential inefficiencies or issues. The water related data can be reported in a drilling rig report (e.g., a drilling morning report), for example, in a section for water consumption.

In some implementations, system 200 can utilize a rig floor safety camera 118 to scan and identify the serial numbers of BHA components, to have a record of the BHA tools used, as well as the configuration, manufacturer, and/or specifications of the BHA tools. In some cases, based on the BHA component data, system 200 can automatically track the wear and tear of BHA tools over time, predict maintenance or replacement needs, and improve the selection of future BHA components based on performance data. System 200 can also trigger alerts when specific components approach their end-of-life or when tools that are no longer meeting predefined conditions are in use. The BHA component data can be reported in a drilling rig report (e.g., a drilling morning report), for example, in a section for bit data and BHA components.

In some implementations, system 200 can utilize a BOP camera 124 that monitors the BOP and sensors that monitor the operational status of the BOP, to detect and record well flow situations as well as situations of BOP testing. In some cases, based on the well flow and BOP related data, system 200 can automatically trigger alerts in the event of abnormal flow conditions or potential BOP failure. System 200 can also initiate automatic system checks or shutdown procedures to mitigate risks and ensure well control safety. The well flow and BOP related data can be reported in a drilling rig report (e.g., a drilling morning report), for example, in a section for well control/BOP testing.

In some implementations, system 200 can utilize surface in-pipe or downhole in-situ drilling fluid sensors to monitor and record drilling fluid properties, for example, density, viscosity, and/or solid size distribution of each drilling fluid, to produce a time-series log of each fluid property throughout the drilling activities. In some cases, based on the drilling fluid property related data, system 200 can automatically adjust the drilling fluid formulation, such as adding or removing additives, to maintain predefined fluid properties for the ongoing drilling conditions. System 200 can also trigger alerts if the fluid properties fall outside of predefined acceptable ranges, prompting manual intervention or adjustment. The drilling fluid property related data can be reported in a drilling rig report (e.g., a drilling morning report), for example, in a section for drilling fluid data.

In some implementations, system 200 can utilize real-time or near-real-time data transmission with magnetometer and/or accelerometer data from the downhole, for example, by utilizing a continuous microchip-based logging, to generate, record, and report wellbore surveys that can be compared against a drilling plan. In some cases, based on the wellbore survey related data, the system can automatically adjust the drilling parameters, such as the drilling direction or angle, to correct deviations from the planned wellbore trajectory. System 200 can also trigger alerts if significant deviations are detected, prompting manual intervention. The wellbore survey related data can be reported in a drilling rig report (e.g., a drilling morning report), for example, in a section for wellbore survey.

In some implementations, mobility devices 108 such as rig robots 142 can be used as a tool of acquiring footage upon request of a user or from angles that are not covered by pre-fixed cameras. Rig robots 142 can also be used as a tool for acquiring readings from existing sensors that do not have data communication features. In some cases, rig robots 142 can also be used for scanning/tagging drilling tools, or implementing functions of sensors, for example, ground sensors for the ground stability measurements, or gas sensors positioned around the perimeters of the rig location or around pre-determined locations, for example, at the pit, which is one of the locations that can show early signs of gas emissions from the wellbore. In some cases, in addition to shutting in the well, system 200 can use data collected by rig UAVs 144 to automatically detect potential hazards, such as gas leaks, or monitor ground stability. In some cases, based on the data collected by rig UAVs 144, system 200 can trigger alerts or take corrective actions, such as adjusting rig operations or shutting down specific equipment to prevent further risk.

In some implementations, rig robots 142 can be used for its actuation functionality to take control action (by making physical changes to tangible systems, such as opening or closing valves) based on the information generated by the collective analysis of other data. For example, when an overflow (e.g., a kick) is detected, the mud data may show an unexpected increased mud levels in the mud system. The unexpected increased mud levels may result in the rig operators to shut in the well. If the shut-in procedure is delayed, there can be uncontrolled outflux of gas or oil from the well to the surface. The uncontrolled outflux of gas or oil can be extremely dangerous for humans to control the well manually. Therefore, rig robots 142 can be used to shut in the well.

In some implementations, mobility devices 108 such as rig UAVs 144 can have similar applications as those of the rig robots 142, with the additional ability to operate from the air. Consequently, compared to the rig robots 142, the rig UAVs 144 can cover more area (for instance, around the perimeters of the rig) with safer angles in some circumstances (for instance, when approaching the rig from above or crosswind). One example application of a rig UAV 144 is to provide aerial footage of a drilling rig site and its perimeters. The aerial footage can be used to monitor rig security, rig traffic (e.g., to monitor trucks of tools, service equipment or personnel, visitors, etc.), and/or rig safety (e.g., to monitor behaviors of personnel at the rig). In some cases, in addition to collecting footage, system 200 can automatically analyze data from rig UAVs 144 to detect unusual behaviors, such as unauthorized access, safety violations, or potential hazards, and take actions such as sending alerts or activating security protocols. The data collected by rig UAVs 144 can be reported under the foreman remarks section, the truck/boats section, and/or the personnel and services information section of a drilling rig report.

In some implementations, drilling rig reports generated by system 200 can be used to monitor the progress of drilling operations at a drilling rig site, such that lessons can be learned, drilling irregularities can be detected in real-time and fixed, future drilling operations can be improved, or offset wells can be studied based on the drilling rig reports. For example, system 200 can track and analyze drilling performance over time, allowing operators to identify trends and make adjustments to improve future drilling processes. In some cases, functionalities of systems at a drilling rig site can be controlled based on the drilling rig reports.

Figure 3:
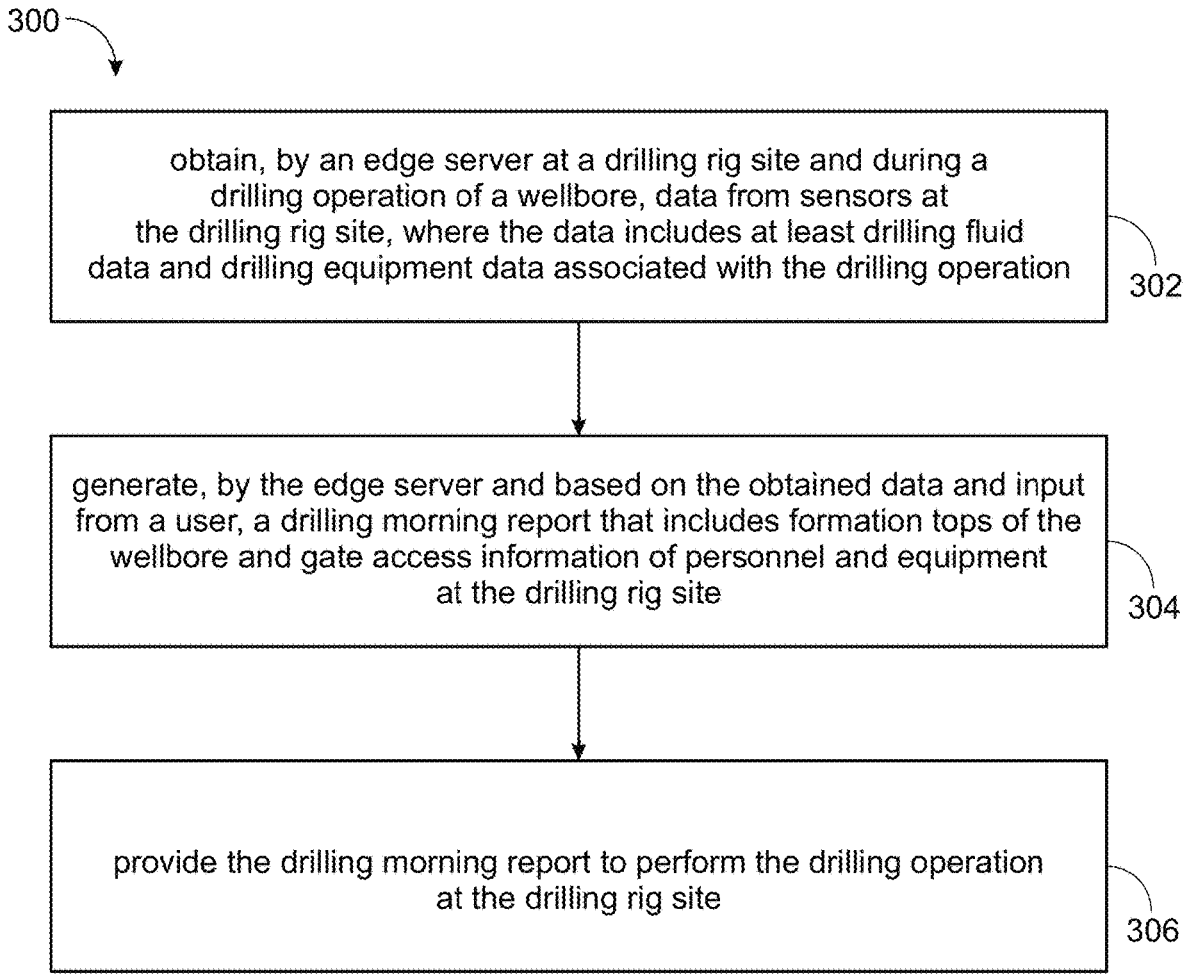
FIG. 3 illustrates an example process of monitoring drilling rig operations, according to some implementations.

FIG. 3 illustrates an example process 300 of monitoring drilling rig operations, according to some implementations. For convenience, process 300 will be described as being performed by a computer system having one or more computers located in one or more locations and programmed appropriately in accordance with this specification. An example of the computer system is the computer system 400 illustrated in FIG. 4.

At 302, a computer system obtains, during a drilling operation of a wellbore and as obtained data from sensors at the drilling rig site, data from sensors at a drilling rig site, where the data from sensors at the drilling rig site includes at least drilling fluid data and drilling equipment data associated with the drilling operation. In some implementations, the computer system can be an edge server at a drilling rig site.

At 304, the computer system generates, based on the obtained data from sensors at the drilling rig site and input from a user, a drilling morning report that includes formation tops of the wellbore and gate access information of personnel and equipment at the drilling rig site.

At 306, the computer system provides the drilling morning report to perform the drilling operation at the drilling rig site.

Figure 4:
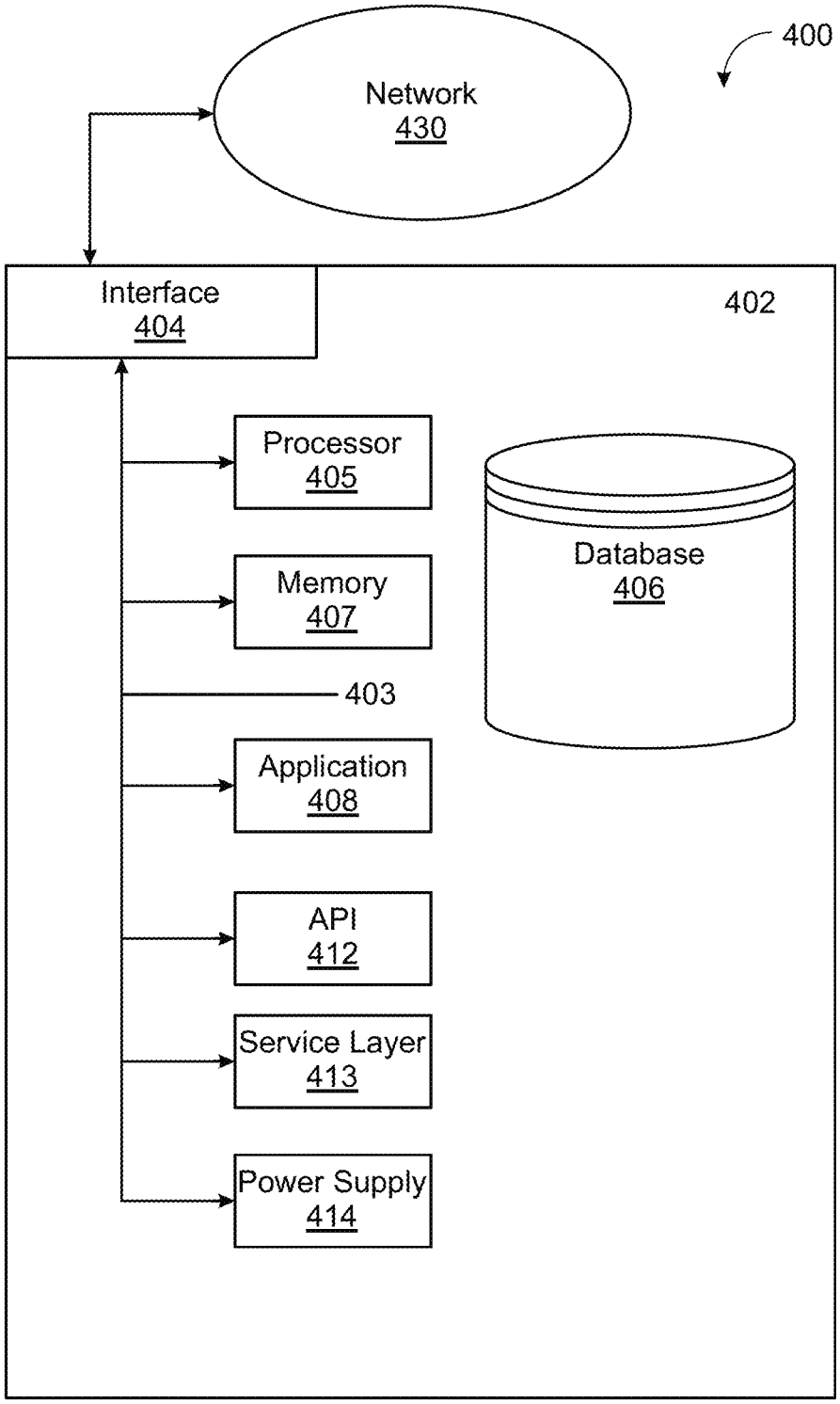
FIG. 4 is a block diagram of an example computer system that can be used to provide computational functionalities associated with described algorithms, methods, functions, processes, flows, and procedures, according to some implementations.

FIG. 4 is a block diagram of an example computer system 400 that can be used to provide computational functionalities associated with described algorithms, methods, functions, processes, flows, and procedures, according to some implementations of the present disclosure. In some implementations, the computer system performing process 300 can be the computer system 400, include the computer system 400, or the computer system performing process 300 can communicate with the computer system 400.

The illustrated computer 402 is intended to encompass any computing device such as a server, a desktop computer, an embedded computer, a laptop/notebook computer, a wireless data port, a smart phone, a personal data assistant (PDA), a tablet computing device, or one or more processors within these devices, including physical instances, virtual instances, or both. The computer 402 can include input devices such as keypads, keyboards, and touch screens that can accept user information. Also, the computer 402 can include output devices that can convey information associated with the operation of the computer 402. The information can include digital data, visual data, audio information, or a combination of information. The information can be presented in a GUI or other user interface. In some implementations, the inputs and outputs include display ports (such as DVI-I+2× display ports), USB 3.0, GbE ports, isolated DI/O, SATA-III (6.0 Gb/s) ports, mPCIe slots, a combination of these, or other ports. In instances of an edge gateway, the computer 402 can include a Smart Embedded Management Agent (SEMA), such as a built-in ADLINK SEMA 2.2, and a video sync technology, such as Quick Sync Video technology supported by ADLINK MSDK+. In some examples, the computer 402 can include the MXE-5400 Series processor-based fanless embedded computer by ADLINK, though the computer 402 can take other forms or include other components.

The computer 402 can serve in a role as a client, a network component, a server, a database, a persistency, or components of a computer system for performing the subject matter described in the present disclosure. The illustrated computer 402 is communicably coupled with a network 430. In some implementations, one or more components of the computer 402 can be configured to operate within different environments, including cloud-computing-based environments, local environments, global environments, and combinations of environments.

At a high level, the computer 402 is an electronic computing device operable to receive, transmit, process, store, and manage data and information associated with the described subject matter. According to some implementations, the computer 402 can also include, or be communicably coupled with, an application server, an email server, a web server, a caching server, a streaming data server, or a combination of servers.

The computer 402 can receive requests over network 430 from a client application (for example, executing on another computer 402). The computer 402 can respond to the received requests by processing the received requests using software applications. Requests can also be sent to the computer 402 from internal users (for example, from a command console), external (or third) parties, automated applications, entities, individuals, systems, and computers.

Each of the components of the computer 402 can communicate using a system bus 403. In some implementations, any or all of the components of the computer 402, including hardware or software components, can interface with each other or the interface 404 (or a combination of both), over the system bus. Interfaces can use an application programming interface (API) 412, a service layer 413, or a combination of the API 412 and service layer 413. The API 412 can include specifications for routines, data structures, and object classes. The API 412 can be either computer-language independent or dependent. The API 412 can refer to a complete interface, a single function, or a set of APIs 412.

The service layer 413 can provide software services to the computer 402 and other components (whether illustrated or not) that are communicably coupled to the computer 402. The functionality of the computer 402 can be accessible for all service consumers using this service layer 413. Software services, such as those provided by the service layer 413, can provide reusable, defined functionalities through a defined interface. For example, the interface can be software written in JAVA, C++, or a language providing data in extensible markup language (XML) format. While illustrated as an integrated component of the computer 402, in alternative implementations, the API 412 or the service layer 413 can be stand-alone components in relation to other components of the computer 402 and other components communicably coupled to the computer 402. Moreover, any or all parts of the API 412 or the service layer 413 can be implemented as child or sub-modules of another software module, enterprise application, or hardware module without departing from the scope of the present disclosure.

The computer 402 can include an interface 404. Although illustrated as a single interface 404 in FIG. 4, two or more interfaces 404 can be used according to particular needs, desires, or particular implementations of the computer 402 and the described functionality. The interface 404 can be used by the computer 402 for communicating with other systems that are connected to the network 430 (whether illustrated or not) in a distributed environment. Generally, the interface 404 can include, or be implemented using, logic encoded in software or hardware (or a combination of software and hardware) operable to communicate with the network 430. More specifically, the interface 404 can include software supporting one or more communication protocols associated with communications. As such, the network 430 or the interface's hardware can be operable to communicate physical signals within and outside of the illustrated computer 402.

The computer 402 includes a processor 405. Although illustrated as a single processor 405 in FIG. 4, two or more processors 405 can be used according to particular needs, desires, or particular implementations of the computer 402 and the described functionality. Generally, the processor 405 can execute instructions and manipulate data to perform the operations of the computer 402, including operations using algorithms, methods, functions, processes, flows, and procedures as described in the present disclosure.

The computer 402 can also include a database 406 that can hold data for the computer 402 and other components connected to the network 430 (whether illustrated or not). For example, database 406 can be an in-memory, conventional, or a database storing data consistent with the present disclosure. In some implementations, the database 406 can be a combination of two or more different database types (for example, hybrid in-memory and conventional databases) according to particular needs, desires, or particular implementations of the computer 402 and the described functionality. Although illustrated as a single database 406 in FIG. 4, two or more databases (of the same, different, or combination of types) can be used according to particular needs, desires, or particular implementations of the computer 402 and the described functionality. While database 406 is illustrated as an internal component of the computer 402, in alternative implementations, database 406 can be external to the computer 402.

The computer 402 also includes a memory 407 that can hold data for the computer 402 or a combination of components connected to the network 430 (whether illustrated or not). Memory 407 can store any data consistent with the present disclosure. In some implementations, memory 407 can be a combination of two or more different types of memory (for example, a combination of semiconductor and magnetic storage) according to particular needs, desires, or particular implementations of the computer 402 and the described functionality. Although illustrated as a single memory 407 in FIG. 4, two or more memories 407 (of the same, different, or combination of types) can be used according to particular needs, desires, or particular implementations of the computer 402 and the described functionality. While memory 407 is illustrated as an internal component of the computer 402, in alternative implementations, memory 407 can be external to the computer 402.

An application 408 can be an algorithmic software engine providing functionality according to particular needs, desires, or particular implementations of the computer 402 and the described functionality. For example, an application 408 can serve as one or more components, modules, or applications 408. Multiple applications 408 can be implemented on the computer 402. Each application 408 can be internal or external to the computer 402.

The computer 402 can also include a power supply 414. The power supply 414 can include a rechargeable or non-rechargeable battery that can be configured to be either user- or non-user-replaceable. In some implementations, the power supply 414 can include power-conversion and management circuits, including recharging, standby, and power management functionalities. In some implementations, the power-supply 414 can include a power plug to allow the computer 402 to be plugged into a wall socket or a power source to, for example, power the computer 402 or recharge a rechargeable battery.

There can be any number of computers 402 associated with, or external to, a computer system including computer 402, with each computer 402 communicating over network 430. Further, the terms "client", "user", and other appropriate terminology can be used interchangeably without departing from the scope of the present disclosure. Moreover, the present disclosure contemplates that many users can use one computer 402 and one user can use multiple computers 402.

Figure 5:
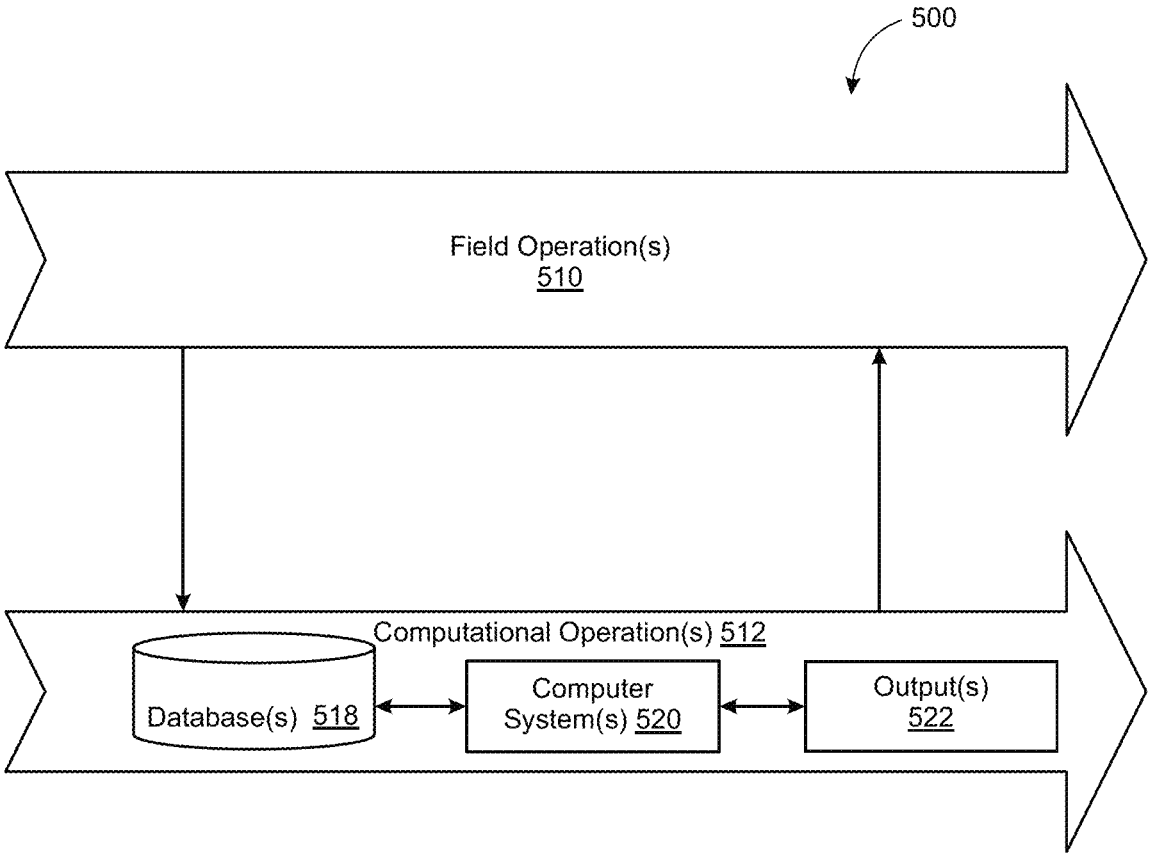
FIG. 5 illustrates hydrocarbon production operations that include both one or more field operations and one or more computational operations, which exchange information and control exploration for the production of hydrocarbons, according to some implementations.

FIG. 5 illustrates hydrocarbon production operations 500 that include both one or more field operations 510 and one or more computational operations 512, which exchange information and control exploration for the production of hydrocarbons, according to some implementations. In some implementations, outputs of techniques of the present disclosure can be performed before, during, or in combination with the hydrocarbon production operations 500, specifically, for example, either as field operations 510 or computational operations 512, or both.

Examples of field operations 510 include forming/drilling a wellbore, hydraulic fracturing, producing through the wellbore, injecting fluids (such as water) through the wellbore, to name a few. In some implementations, methods of the present disclosure can trigger or control the field operations 510. For example, the methods of the present disclosure can generate data from hardware/software including sensors and physical data gathering equipment (e.g., seismic sensors, well logging tools, flow meters, and temperature and pressure sensors). The methods of the present disclosure can include transmitting the data from the hardware/software to the field operations 510 and responsively triggering the field operations 510 including, for example, generating plans and signals that provide feedback to and control physical components of the field operations 510. Alternatively, or in addition, the field operations 510 can trigger the methods of the present disclosure. For example, implementing physical components (including, for example, hardware, such as sensors) deployed in the field operations 510 can generate plans and signals that can be provided as input or feedback (or both) to the methods of the present disclosure.

Examples of computational operations 512 include one or more computer systems 520 that include one or more processors and computer-readable media (e.g., non-transitory computer-readable media) operatively coupled to the one or more processors to execute computer operations to perform the methods of the present disclosure. The computational operations 512 can be implemented using one or more databases 518, which store data received from the field operations 510 or generated internally within the computational operations 512 (e.g., by implementing the methods of the present disclosure) or both. For example, the one or more computer systems 520 process inputs from the field operations 510 to assess conditions in the physical world, the outputs of which are stored in the databases 518. For example, seismic sensors of the field operations 510 can be used to perform a seismic survey to map subterranean features, such as facies and faults. In performing a seismic survey, seismic sources (e.g., seismic vibrators or explosions) generate seismic waves that propagate in the earth and seismic receivers (e.g., geophones) measure reflections generated as the seismic waves interact with boundaries between layers of a subsurface formation. The source and received signals are provided to the computational operations 512 where they are stored in the databases 518 and analyzed by the one or more computer systems 520.

In some implementations, one or more outputs 522 generated by the one or more computer systems 520 can be provided as feedback/input to the field operations 510 (either as direct input or stored in the databases 518). The field operations 510 can use the feedback/input to control physical components used to perform the field operations 510 in the real world.

For example, the computational operations 512 can process the seismic data to generate three-dimensional maps of the subsurface formation. The computational operations 512 can use these 3D maps to provide plans for locating and drilling exploratory wells. In some operations, the exploratory wells are drilled using logging-while-drilling (LWD) techniques which incorporate logging tools into the drill string. LWD techniques can enable the computational operations 512 to process new information about the formation and control the drilling to adjust to the observed conditions in real-time.

The one or more computer systems 520 can update the 3D maps of the subsurface formation as information from one exploration well is received and the computational operations 512 can adjust the location of the next exploration well based on the updated 3D maps. Similarly, the data received from production operations can be used by the computational operations 512 to control components of the production operations. For example, production well and pipeline data can be analyzed to predict slugging in pipelines leading to a refinery and the computational operations 512 can control machine operated valves upstream of the refinery to reduce the likelihood of plant disruptions that run the risk of taking the plant offline.

In some implementations of the computational operations 512, customized user interfaces can present intermediate or final results of the above-described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or app), or at a central processing facility.

The presented information can include feedback, such as changes in parameters or processing inputs, that the user can select to improve a production environment, such as in the exploration, production, or testing of petrochemical processes or facilities. For example, the feedback can include parameters that, when selected by the user, can cause a change to, or an improvement in, drilling parameters (including drill bit speed and direction) or overall production of a gas or oil well. The feedback, when implemented by the user, can improve the speed and accuracy of calculations, streamline processes, improve models, and solve problems related to efficiency, performance, safety, reliability, costs, downtime, and the need for human interaction.

In some implementations, the feedback can be implemented in real-time, such as to provide an immediate or near-immediate change in operations or in a model. The term real-time (or similar terms as understood by one of ordinary skill in the art) means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second(s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment or systems at a facility. This can be especially useful for systems or various pieces of equipment that are located several meters or several miles apart, or are located in different countries or other jurisdictions.

Implementations of the subject matter and the functional operations described in this specification can be implemented in digital electronic circuitry, in tangibly embodied computer software or firmware; in computer hardware, including the structures disclosed in this specification and their structural equivalents; or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus", "computer", and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus and special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, Linux, Unix, Windows, Mac OS, Android, or iOS.

A computer program, which can also be referred to or described as a program, software, a software application, a module, a software module, a script, or code can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document; in a single file dedicated to the program in question; or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes; the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks, optical memory devices, and technologies including, for example, digital video disc (DVD), CD ROM, DVD+/−R, DVD-RAM, DVD-ROM, HD-DVD, and BLURAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), or a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser. Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, or in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations; and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

EMBODIMENTS

Embodiment 1: A computer-implemented method includes obtaining, by an edge server at a drilling rig site during a drilling operation of a wellbore, data from sensors at the drilling rig site. The data includes at least drilling fluid data and drilling equipment data associated with the drilling operation. A drilling morning report is generated by the edge server and based on the obtained data from sensors at the drilling rig site and input from a user. The drilling morning report includes formation tops of the wellbore and gate access information of personnel and equipment at the drilling rig site. The drilling morning report is provided to perform the drilling operation at the drilling rig site.

Embodiment 2: The computer-implemented method of embodiment 1, where the sensors at the drilling rig site include at least one of a surveillance camera, a rig sensor, an internet of things (IoT) sensor, or a rig mobility device, and the rig mobility device includes one or more unmanned aerial vehicles (UAVs) or one or more rig robots.

Embodiment 3: The computer-implemented method of embodiment 1 or 2, where the data from sensors at the drilling rig site further includes at least one of downhole and surface drillstring vibration data, footage of a rig floor of the drilling rig site, or gate access data for the equipment and the personnel at the drilling rig site, and the gate access data is obtained from an automated tagging device at a gate of the drilling rig site.

Embodiment 4: The computer-implemented method of embodiment 3, where the data from sensors at the drilling rig site includes the downhole and surface drillstring vibration data, and generating the drilling morning report includes determining, as determined formation tops, the formation tops of the wellbore using the downhole and surface drillstring vibration data, and adjusting at least one of weight on bit (WOB), rotary speed, or drilling fluid properties based on the determined formation tops of the wellbore.

Embodiment 5: The computer-implemented method of embodiment 3 or 4, where the data from sensors at the drilling rig site includes the footage of the rig floor of the drilling rig site, and generating the drilling morning report includes at least one of identifying a major operation at the drilling rig site using the footage of the rig floor, or triggering alerts or adjustments to operational parameters if irregularities are detected during the drilling operation.

Embodiment 6: The computer-implemented method of one of embodiments 1 to 5, where the input from the user is through an interactive interface with the user or automatically provided by an artificial intelligence system integrated with the edge server.

Embodiment 7: The computer-implemented method of any one of embodiments 1 to 6, where the drilling fluid data includes data from at least one of a mud tank fluid level gauge, a surface rheology and density meter, or a downhole density and rheology sensor.

Embodiment 8: The computer-implemented method of any one of embodiments 1 to 7, where the drilling equipment data includes at least one of blowout preventor (BOP) operational status data or serial numbers of bottomhole assembly (BHA) components at the drilling rig site.

Embodiment 9: The computer-implemented method of any one of embodiments 1 to 8, where the drilling morning report further includes at least one of drilling fluid status during the drilling operation, power generation and distribution at the drilling rig site, or a wellbore survey including deviations from planned trajectories of the wellbore.

Embodiment 10: The computer-implemented method of any one of embodiments 1 to 9, where providing the drilling morning report to perform the drilling operation at the drilling rig site includes at least one of adjusting, based on the drilling morning report, operational parameters of drilling equipment used for the drilling operation, or reusing drilling fluids during the drilling operation by mixing, based on the drilling fluid data, additives with the drilling fluids.

Embodiment 11: The computer-implemented method of any one of embodiments 1 to 10, where providing the drilling morning report to perform the drilling operation at the drilling rig site includes adjusting, based on the drilling morning report and predefined thresholds, operational parameters of drilling equipment for the drilling operation.

Embodiment 12: The computer-implemented method of any one of embodiments 1 to 11, where providing the drilling morning report to perform the drilling operation at the drilling rig site includes adjusting composition of drilling fluids for the drilling operation based on the drilling fluid data.

Embodiment 13: The computer-implemented method of any one of embodiments 1 to 12, where providing the drilling morning report to perform the drilling operation at the drilling rig site includes at least one of tracking, based on the drilling morning report, wear and tear of equipment used in the drilling operation, or predicting maintenance requirements for the equipment.

Embodiment 14: A non-transitory computer-readable medium storing one or more instructions executable by a computer system to perform operations including obtaining, by an edge server at a drilling rig site during a drilling operation of a wellbore, data from sensors at the drilling rig site. The data includes at least drilling fluid data and drilling equipment data associated with the drilling operation. A drilling morning report is generated by the edge server and based on the obtained data from sensors at the drilling rig site and input from a user. The drilling morning report includes formation tops of the wellbore and gate access information of personnel and equipment at the drilling rig site. The drilling morning report is provided to perform the drilling operation at the drilling rig site.

Embodiment 15: The non-transitory computer-readable medium of embodiment 14, where the sensors at the drilling rig site includes at least one of a surveillance camera, a rig sensor, an internet of things (IoT) sensor, or a rig mobility device, and the rig mobility device includes one or more unmanned aerial vehicles (UAVs) or one or more rig robots.

Embodiment 16: The non-transitory computer-readable medium of embodiment 14 or 15, where the data from sensors at the drilling rig site further includes at least one of downhole and surface drillstring vibration data, footage of a rig floor of the drilling rig site, or gate access data for the equipment and the personnel at the drilling rig site, and the gate access data is obtained from an automated tagging device at a gate of the drilling rig site.

Embodiment 17: The non-transitory computer-readable medium of embodiment 16, where the data from sensors at the drilling rig site includes the downhole and surface drillstring vibration data, and generating the drilling morning report includes determining, as determined formation tops, the formation tops of the wellbore using the downhole and surface drillstring vibration data, and adjusting at least one of weight on bit (WOB), rotary speed, or drilling fluid properties based on the determined formation tops of the wellbore.

Embodiment 18: A computer-implemented system, including one or more computers; and one or more computer memory devices interoperably coupled with the one or more computers and having tangible, non-transitory, machine-readable media storing one or more instructions that, when executed by the one or more computers, perform one or more operations including obtaining, by an edge server at a drilling rig site during a drilling operation of a wellbore, data from sensors at the drilling rig site. The data includes at least drilling fluid data and drilling equipment data associated with the drilling operation. A drilling morning report is generated by the edge server and based on the obtained data from sensors at the drilling rig site and input from a user. The drilling morning report includes formation tops of the wellbore and gate access information of personnel and equipment at the drilling rig site. The drilling morning report is provided to perform the drilling operation at the drilling rig site.

Embodiment 19: The computer-implemented system of embodiment 18, where the sensors at the drilling rig site includes at least one of a surveillance camera, a rig sensor, an internet of things (IoT) sensor, or a rig mobility device, and the rig mobility device includes one or more unmanned aerial vehicles (UAVs) or one or more rig robots.

Embodiment 20: The computer-implemented system of embodiment 18, where the data from sensors at the drilling rig site further includes at least one of downhole and surface drillstring vibration data, footage of a rig floor of the drilling rig site, or gate access data for the equipment and the personnel at the drilling rig site, and the gate access data is obtained from an automated tagging device at a gate of the drilling rig site.

What is claimed is:

1. A computer-implemented method, comprising:

obtaining, by an edge server at a drilling rig site during a drilling operation of a wellbore and as obtained data from sensors at the drilling rig site, data from sensors at the drilling rig site, wherein the data from sensors at the drilling rig site comprises at least drilling fluid data and drilling equipment data associated with the drilling operation, wherein the data from sensors at the drilling rig site comprises downhole drillstring vibration data and surface drillstring vibration data;

determining formation tops of the wellbore by cross referencing a drilling plan and analytics of cuttings generated at a shell shaker with the downhole drillstring vibration data and the surface drillstring vibration data;

generating, by the edge server and based on the obtained data from sensors at the drilling rig site and input from a user, a drilling morning report that comprises the formation tops of the wellbore and gate access information of personnel and equipment at the drilling rig site; and performing the drilling operation at the drilling rig site based on the drilling morning report, wherein the drilling operation comprises adjusting at least one of weight on bit (WOB), rotary speed, or drilling fluid properties based on the formation tops of the wellbore.

2. The computer-implemented method of claim 1, wherein the sensors at the drilling rig site comprise at least one of a surveillance camera, a rig sensor, an internet of things (IoT) sensor, or a rig mobility device, and wherein the rig mobility device comprises one or more unmanned aerial vehicles (UAVs) or one or more rig robots.

3. The computer-implemented method of claim 1, wherein the data from sensors at the drilling rig site further comprises at least one of downhole and surface drillstring vibration data, footage of a rig floor of the drilling rig site, or gate access data for the equipment and the personnel at the drilling rig site, and the gate access data is obtained from an automated tagging device at a gate of the drilling rig site.

4. The computer-implemented method of claim 3, wherein determining the formation tops of the wellbore comprises auto-generating depths of formation tops once the formation tops are hit by the drillstring during the drilling operation.

5. The computer-implemented method of claim 3, wherein the data from sensors at the drilling rig site comprises the footage of the rig floor of the drilling rig site, and generating the drilling morning report comprises at least one of:

identifying a major operation at the drilling rig site using the footage of the rig floor; or triggering alerts or adjustments to operational parameters if irregularities are detected during the drilling operation.

6. The computer-implemented method of claim 1, wherein the input from the user is through an interactive interface with the user or automatically provided by an artificial intelligence system integrated with the edge server.

7. The computer-implemented method of claim 1, wherein the drilling fluid data comprises data from at least one of a mud tank fluid level gauge, a surface rheology and density meter, or a downhole density and rheology sensor.

8. The computer-implemented method of claim 1, wherein the drilling equipment data comprises at least one of blowout preventor (BOP) operational status data or serial numbers of bottomhole assembly (BHA) components at the drilling rig site.

9. The computer-implemented method of claim 1, wherein the drilling morning report further comprises at least one of drilling fluid status during the drilling operation, power generation and distribution at the drilling rig site, or a wellbore survey comprising deviations from planned trajectories of the wellbore.

10. The computer-implemented method of claim 1, wherein providing the drilling morning report to perform the drilling operation at the drilling rig site comprises at least one of:

adjusting, based on the drilling morning report, operational parameters of drilling equipment used for the drilling operation; or reusing drilling fluids during the drilling operation by mixing, based on the drilling fluid data, additives with the drilling fluids.

11. The computer-implemented method of claim 1, wherein providing the drilling morning report to perform the drilling operation at the drilling rig site comprises:

adjusting, based on the drilling morning report and predefined thresholds, operational parameters of drilling equipment for the drilling operation.

12. The computer-implemented method of claim 1, wherein providing the drilling morning report to perform the drilling operation at the drilling rig site comprises:

adjusting composition of drilling fluids for the drilling operation based on the drilling fluid data.

13. The computer-implemented method of claim 1, wherein providing the drilling morning report to perform the drilling operation at the drilling rig site comprises at least one of:

tracking, based on the drilling morning report, wear and tear of equipment used in the drilling operation; or predicting maintenance requirements for the equipment.

14. A non-transitory computer-readable medium storing one or more instructions executable by a computer system to perform operations comprising:

obtaining, by an edge server at a drilling rig site during a drilling operation of a wellbore and as obtained data from sensors at the drilling rig site, data from sensors at the drilling rig site, wherein the data from sensors at the drilling rig site comprises at least drilling fluid data and drilling equipment data associated with the drilling operation, wherein the data from sensors at the drilling rig site comprises downhole drillstring vibration data and surface drillstring vibration data;

determining formation tops of the wellbore by cross referencing a drilling plan and analytics of cuttings generated at a shell shaker with the downhole drillstring vibration data and the surface drillstring vibration data;

generating, by the edge server and based on the obtained data from sensors at the drilling rig site and input from a user, a drilling morning report that comprises the formation tops of the wellbore and gate access information of personnel and equipment at the drilling rig site; and performing the drilling operation at the drilling rig site based on the drilling morning report, wherein the drilling operation comprises adjusting at least one of weight on bit (WOB), rotary speed, or drilling fluid properties based on the formation tops of the wellbore.

15. The non-transitory computer-readable medium of claim 14, wherein the sensors at the drilling rig site comprise at least one of a surveillance camera, a rig sensor, an internet of things (IoT) sensor, or a rig mobility device, and wherein the rig mobility device comprises one or more unmanned aerial vehicles (UAVs) or one or more rig robots.

16. The non-transitory computer-readable medium of claim 14, wherein the data from sensors at the drilling rig site further comprises at least one of downhole and surface drillstring vibration data, footage of a rig floor of the drilling rig site, or gate access data for the equipment and the personnel at the drilling rig site, and the gate access data is obtained from an automated tagging device at a gate of the drilling rig site.

17. The non-transitory computer-readable medium of claim 16, wherein determining the formation tops of the wellbore comprises auto-generating depths of formation tops once the formation tops are hit by the drillstring during the drilling operation.

18. A computer-implemented system comprising:

one or more computers; and one or more computer memory devices interoperably coupled with the one or more computers and having tangible, non-transitory, machine-readable media storing one or more instructions that, when executed by the one or more computers, cause the computer-implemented system to perform one or more operations comprising:

obtaining, by an edge server at a drilling rig site during a drilling operation of a wellbore and as obtained data from sensors at the drilling rig site, data from sensors at the drilling rig site, wherein the data from sensors at the drilling rig site comprises at least drilling fluid data and drilling equipment data associated with the drilling operation, wherein the data from sensors at the drilling rig site comprises downhole drillstring vibration data and surface drillstring vibration data;

determining formation tops of the wellbore by cross referencing a drilling plan and analytics of cuttings generated at a shell shaker with the downhole drillstring vibration data and the surface drillstring vibration data;

generating, by the edge server and based on the obtained data from sensors at the drilling rig site and input from a user, a drilling morning report that comprises the formation tops of the wellbore and gate access information of personnel and equipment at the drilling rig site; and performing the drilling operation at the drilling rig site based on the drilling morning report, wherein the drilling operation comprises adjusting at least one of weight on bit (WOB), rotary speed, or drilling fluid properties based on the formation tops of the wellbore.

19. The computer-implemented system of claim 18, wherein the sensors at the drilling rig site comprise at least one of a surveillance camera, a rig sensor, an internet of things (IoT) sensor, or a rig mobility device, and wherein the rig mobility device comprises one or more unmanned aerial vehicles (UAVs) or one or more rig robots.

20. The computer-implemented system of claim 18, wherein the data from sensors at the drilling rig site further comprises at least one of downhole and surface drillstring vibration data, footage of a rig floor of the drilling rig site, or gate access data for the equipment and the personnel at the drilling rig site, and the gate access data is obtained from an automated tagging device at a gate of the drilling rig site.

* * * * *